US008844271B2

(12) United States Patent
Huber et al.

(10) Patent No.: US 8,844,271 B2
(45) Date of Patent: Sep. 30, 2014

(54) METHOD AND APPARATUS FOR REGENERATING A CATALYZED DIESEL PARTICULATE FILTER (DPF) VIA ACTIVE NO2-BASED REGENERATION WITH ENHANCED EFFECTIVE NO2 SUPPLY

(75) Inventors: Jeffrey A. Huber, Greencastle, PA (US); Kenth I. Svensson, Hagerstown, MD (US)

(73) Assignee: Mack Trucks, Inc., Greensboro, NC (US)

( * ) Notice: Subject to any disclaimer, the term of this patent is extended or adjusted under 35 U.S.C. 154(b) by 155 days.

(21) Appl. No.: 12/864,328

(22) PCT Filed: Feb. 9, 2009

(86) PCT No.: PCT/US2009/033510

§ 371 (c)(1),
(2), (4) Date: Jul. 23, 2010

(87) PCT Pub. No.: WO2009/100412

PCT Pub. Date: Aug. 13, 2009

(65) Prior Publication Data

US 2010/0326055 A1 Dec. 30, 2010

Related U.S. Application Data

(60) Provisional application No. 61/063,900, filed on Feb. 7, 2008.

(51) Int. Cl.

| | |
|---|---|
| ***F01N 3/023*** | (2006.01) |
| ***F02D 41/14*** | (2006.01) |
| ***F02D 41/02*** | (2006.01) |
| ***F01N 3/035*** | (2006.01) |
| ***F01N 3/025*** | (2006.01) |

(52) U.S. Cl.

CPC ..... *F01N 3/035* (2013.01); *F02D 2200/0802* (2013.01); *F02D 41/1462* (2013.01); *F01N 2610/00* (2013.01); *F02D 41/029* (2013.01); *F02D 41/1446* (2013.01); *F01N 3/0253* (2013.01)

USPC ..... 60/295; 60/274; 60/287; 60/288; 60/297

(58) Field of Classification Search

USPC ..... 60/287, 288, 295, 274, 297

See application file for complete search history.

(56) References Cited

U.S. PATENT DOCUMENTS 4,257,225 A * 3/1981 Crone, Jr. ..... 60/274
6,546,717 B1 4/2003 Chandler et al.

(Continued)

FOREIGN PATENT DOCUMENTS

FR 2859240 A1 3/2005
JP 2001050031 A * 2/2001 ..... F01N 3/02

(Continued)

OTHER PUBLICATIONS

Machine Translation of JP 2001050031 A.*

(Continued)

*Primary Examiner* — Thomas Denion
*Assistant Examiner* — Brandon Lee
(74) *Attorney, Agent, or Firm* — WRB-IP LLP

(57) ABSTRACT

In a method for regenerating s catalyzed diesel particulate filter (DPF) via active NO2-based regeneration with enhanced effective NO2 supply, a NOx containing gas is introduced into the DPF, and a temperature of at least one of the DPF, the NOx containing gas, and soot in the DPF is controlled while control Sing NOx levels at an inlet of the DflF so that the NOx containing gas reacts with the catalyst to form N 02 molecules that thereafter react with soot particles to form CO, CO2, and NO molecules and a N02 efficiency is greater than 0.52 gC/gNO2 and so that less than two thirds of the soot mass that is removed from the DPF is oxidized by 02 molecules in the gas to form CO and CO2 molecules.

36 Claims, 4 Drawing Sheets

(56) References Cited

U.S. PATENT DOCUMENTS

| | | | | |
|---|---|---|---|---|
| 6,829,890 | B2 | 12/2004 | Gui et al. | |
| 6,843,054 | B2 * | 1/2005 | Taylor et al. | 60/275 |
| 6,854,265 | B2 | 2/2005 | Saito et al. | |
| 6,910,329 | B2 | 6/2005 | Bunting et al. | |
| 6,978,604 | B2 * | 12/2005 | Wang et al. | 60/297 |
| 7,055,311 | B2 | 6/2006 | Beutel et al. | |
| 2004/0144082 | A1 * | 7/2004 | Mianzo et al. | 60/285 |
| 2004/0204818 | A1 * | 10/2004 | Trudell et al. | 701/114 |
| 2006/0191258 | A1 | 8/2006 | Opris | |
| 2007/0122319 | A1 * | 5/2007 | Dacosta et al. | 422/180 |
| 2007/0234711 | A1 | 10/2007 | Berke et al. | |

FOREIGN PATENT DOCUMENTS

| | | | | | |
|---|---|---|---|---|---|
| JP | 2002-21623 | A | | 1/2002 | |
| JP | 2002276443 | A | | 9/2002 | |
| JP | 2003049637 | A | * | 2/2003 | F01N 3/08 |
| JP | 2003-74394 | A | | 3/2003 | |
| JP | 2003-293730 | A | | 10/2003 | |
| JP | 2007-187006 | A | | 7/2007 | |

OTHER PUBLICATIONS

Machine tranlation of JP 2003049637A.*

International Search Report for corresponding International Application PCT/US2009/033510.

International Preliminary Report on Patentability for corresponding International Application PCT/US2009/033510.

Supplemental International Preliminary Report on Patentability for corresponding International Application PCT/US2009/033510.

Japan Official Action (Translated) for corresponding Japan application No. 2010-546085.

Japan Official Action (Translated) dated Mar. 4, 2014, for corresponding Japan application No. 2010-546085.

* cited by examiner

Absolute Soot Load Density (g/L)

| Example | Total Event Time (min) 0 | 10 | 25 | 60 | 120 | 180 |
|---|---|---|---|---|---|---|
| 1 | 4.23 | | | 2.05 | 0.95 | |
| 2 | 4.30 | | | 3.20 | 1.98 | 1.28 |
| 3A | 4.57 | 2.79 | | | | |
| 3B | 5.23 | | 0.68 | | | |

METHOD AND APPARATUS FOR REGENERATING A CATALYZED DIESEL PARTICULATE FILTER (DPF) VIA ACTIVE NO2-BASED REGENERATION WITH ENHANCED EFFECTIVE NO2 SUPPLY

BACKGROUND AND SUMMARY

The present application is related to commonly assigned, copending Application No. PCT/US09/33512 entitled METHOD AND APPARATUS FOR NO2-BASED REGENERATION OF DIESEL PARTICULATE FILTERS USING RECIRCULATED NOX, filed on the same date as the present application, and claims the benefit of U.S. Provisional Application 61/063,900, filed Feb. 7, 2009, entitled METHOD FOR MAXIMIZING SOOT REDUCTION CAPACITY OF NO2 REACTANT FOR ACTIVE NO2 REGENERATION OF PARTICULATE FILTER.

The invention relates to methods and apparatus for regeneration of diesel particulate filters (DPFs), that is, removal of accumulated particulate matter or soot from the DPF, and more particularly to methods and apparatus involving an oxidation reaction with NO2.

The most common method for removal of soot from a DPF is oxidation of the trapped soot to produce gaseous products (CO2 and CO) which can pass through the filter media; this process is referred to as regeneration. There are two primary mechanisms employed for regeneration: oxidation of soot by O2 ((C+O2→CO2) and/or (2C+O2→2CO)) called O2-based regeneration and oxidation of soot by NO2 ((C+2NO2→CO2+2NO) and/or (C+NO2→CO+NO)) called NO2-based regeneration.

Presently known and implemented solutions for DPF regeneration comprise active O2-based regeneration systems, passive NO2-based regeneration systems, or a combination thereof. Active O2-based regeneration systems raise the temperature of the reactants, through a variety of methods, in order to establish and sustain an O2/soot reaction. During active O2-based regenerations, substantially all soot removal is via reaction with O2. Passive NO2-based systems use catalyzing agents to form NO2 from NO already present in the exhaust gas, typically in an oxidation catalyst upstream of the DPF, and to reduce the activation energy required for a NO2/soot reaction to occur at temperature levels achievable in some portion of the normal engine operation range without active thermal management of the reactants.

Many implementations of the active O2-based and passive NO2-based concepts for DPF regeneration have been demonstrated. The primary limitation of passive NO2-based regeneration is its inability to guarantee adequate regeneration of the DPF in all applications. To solve this, active O2-based regeneration is implemented alternatively to, or in addition to, passive NO2-based regeneration. The primary limitations of O2-based regenerations are lower maximum DPF soot loading levels, which must be observed, and a significantly higher temperature requirement than is necessary for NO2-based regeneration. The higher temperature requirement, as well as the need for more frequent regenerations, can lead to deterioration in the performance and durability of all affected exhaust aftertreatment devices, including those downstream of the soot filtration and regeneration components, such as an SCR system. Solution of the temperature problem must be resolved through the development of more robust aftertreatment devices and/or the implementation of additional devices, systems and/or methods to reduce post-DPF temperatures.

Some methods have been proposed that are supplemental to the active O2-based and passive NO2-based regenerations concepts. U.S. Patent Application Publication No. 2007/0234711 discusses a method to initiate an alternative control strategy with optimal NOx production during operating regimes where adequate reactant temperatures have been passively established. U.S. Pat. No. 6,910,329 B2 discusses a method whereby reactant temperatures and DPF volumetric flow (and thereby DPF residence time) are actively manipulated in order to extend the operating regimes where adequate passive NO2-based regeneration activity can be achieved.

In accordance with an aspect of the present invention, a method for regenerating a catalyzed diesel particulate filter (DPF) via active NO2-based regeneration with enhanced effective NO2 supply comprises introducing a NOx containing gas into the DPF, and controlling a temperature of at least one of the DPF, the NOx containing gas, and soot in the DPF while controlling NOx levels at an inlet of the DPF so that the NOx containing gas reacts with the catalyst to form NO2 molecules that thereafter react with soot particles to form CO, CO2, and NO molecules and a NO2 efficiency is greater than 0.52 gC/gNO2 and so that less than two thirds of the soot mass that is removed from the DPF is oxidized by O2 molecules in the gas to form CO and CO2 molecules.

In accordance with yet another aspect of the present invention, a diesel engine arrangement comprises a diesel engine arranged to introduce a NOx containing gas into a catalyzed diesel particulate filter (DPF), a heating arrangement arranged to control a temperature of at least one of the DPF, the NOx containing gas, and soot in the DPF, and a controller arranged to control the heating arrangement to perform an active NO2-based regeneration with enhanced effective NO2 supply by controlling the temperature and by controlling NOx levels at an inlet of the DPF so that the NOx containing gas reacts with the catalyst to form NO2 molecules that thereafter react with soot particles to form CO, CO2, and NO molecules and a NO2 efficiency is greater than 0.52 gC/gNO2 and so that less than two thirds of the soot mass that is removed from the DPF is oxidized by O2 molecules in the gas to form CO and CO2 molecules.

In accordance with yet another aspect of the present invention, a method of regenerating a diesel particulate filter (DPF) comprises performing a first regeneration to at least partially regenerate the DPF by performing an active NO2-based regeneration with enhanced effective NO2 supply, the active NO2-based regeneration with enchanced effective NO2 supply comprising introducing a NOx containing gas into the DPF, and controlling a temperature of at least one of the DPF, the NOx containing gas, and soot in the DPF while controlling NOx levels at an inlet of the DPF so that the NOx containing gas reacts with the catalyst to form NO2 molecules that thereafter react with soot particles to form CO, CO2, and NO molecules and a NO2 efficiency is greater than 0.52 gC/gNO2 and so that less than two thirds of the soot mass that is removed from the DPF is oxidized by O2 molecules in the gas to form CO and CO2 molecules, and performing a second regeneration to at least partially regenerate the DPF by performing at least one of a conventional NO2-based regeneration and an active O2-based regeneration.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
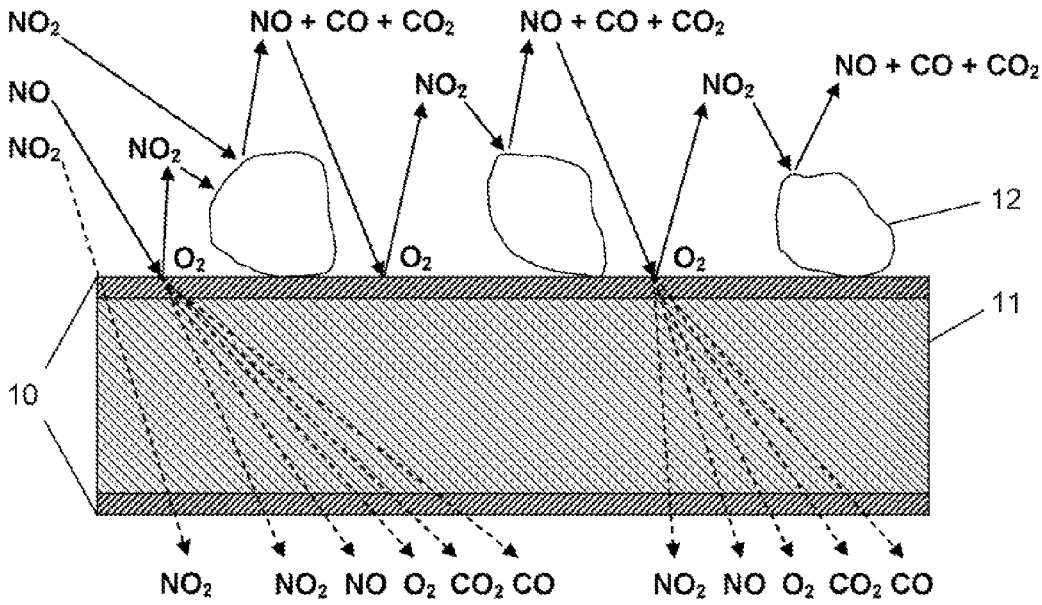
FIG. 1 schematically shows, in partial cross-section, a portion of a DPF channel wall illustrating NO recycling according to an aspect of the present invention.

The invention shall first be described in general, more theoretical terms, as presently understood by the inventors, and, thereafter, in terms of more specific aspects. The invention is not to be considered to be limited by the theories that are set forth herein to explain the inventors' present understanding of how the invention works, except to the extent that such theories are expressly included in the claims.

The inventors recognize that there are two ways in which the reaction rate of the soot in the DPF is limited. The reaction will either be kinetically controlled (due to too low reactant temperature) or diffusion limited (due to too low supply of reactant). Simply stated, the necessary reactants must be supplied and the minimum activation energy for the reaction must be achieved. These conditions may be fulfilled either through active control or achieved passively during normal operation.

For any type of active regeneration process utilizing active thermal control, the temperature of the reactants is raised to the point that a sufficient reaction rate is established for the desired reaction. This is typically achieved by raising the temperature of the filter media, the exhaust gas and/or captured soot above their normal operating temperatures, which would be insufficient to support regeneration, by external means (through catalytic oxidation of hydrocarbons, burner systems, electrical heating, microwaves, etc . . . ). An active regeneration process could implement active control of reactant supply, although this has not been done. For example, O2-based regenerations are kinetically controlled and have plentiful O2, while conventional NO2 strategies do not typically actively regulate NO2 or NOx supply.

By definition, a passive regeneration system will not actively control reactant temperature or reactant supply for the purposes of promoting regeneration. However, several passive means are used to promote regeneration activity. Specifically, catalyzing agents that are in contact with the captured soot, such as a catalyst coating in the DPF, are used to lower the required activation energy (temperature) for the relevant reactions, thereby lessening kinetic control of the reaction (i.e., enabling a higher reaction rate). If a sufficiently high reactant temperature is present, one that will more than support complete reaction of all reactants, then the reaction is diffusion limited. In the case of a DPF full of soot, a diffusion limited reaction implies that supply of the oxygen-bearing reactant is limited. Therefore, catalysts can be used to passively increase reactant supply, such as converting unusable NO to useful NO2, thereby lessening the diffusion limitation of the reaction (i.e., enabling a higher reaction rate).

When considering the practical application of the soot oxidation process, i.e., removing soot from a DPF, distinctions between reaction rate, soot oxidation rate, engine soot production rate, and soot removal rate must be made. One might start from the practical end objective, that is DPF soot removal, and proceed backwards to the more foundational theoretical concept of the chemical reaction rate. The soot mass removal rate is simply the change in DPF soot mass per time. The soot removal rate will not be constant during a regeneration event since it is a function of the captured soot mass, which is changing with time. The soot removal rate is equal to the difference between the soot oxidation rate and the engine soot production rate. Equation 1 describes the soot mass in the DPF as a function of time.

$$\underbrace{m_{DPF\ soot}(t')}_{\substack{mass\ in\ DPF \\ at\ time\ t'}} = \int_0^{t'} \underbrace{\dot{m}_{engine\ soot\ production}}_{\substack{soot\ production \\ rate}} dt + \int_0^{t'} \underbrace{\dot{m}_{DPF\ soot}}_{\substack{soot\ condition \\ rate}} dt + \underbrace{m_{DPF\ soot}(t'=0)}_{initial\ value} \quad \text{Eq. 1}$$

There are several consequences of the relationship between soot load density, soot oxidation rate and soot production. For a stabilized regeneration process (where regeneration conditions, including temperature and reactant supply are already stabilized), the highest soot oxidation rate and soot removal rate are achieved at the beginning of the regeneration event. As the regeneration progresses, the soot oxidation rate will decay until it eventually intersects with the soot production rate, at which point the soot removal rate will equal zero. Consequently, all regeneration processes, including active O2-based regeneration, will approach a non-zero equilibrium soot loading. For particularly efficacious strategies, nearly complete soot regeneration may be approached, but not reached.

The soot oxidation rate, expressed in Eq. 2, is equal to the captured soot mass times the chemical reaction rate. The reaction rate is a function of primarily temperature and amount of NO2 participating in the reaction, which is a function of NO2 supply, soot mass, and number of recycles, where a "recycle" is defined as, on average, one NO2 molecule participating in the oxidation reaction of more than one C atom. Since recycles are NO oxidation reactions, the number of recycles is determined primarily by the NO oxidation reaction rate and residence time. The NO oxidation reaction rate is primarily a function of temperature, reactant availability, and catalyst availability.

$$m_{DPF\ soot} = -m^{\alpha}_{DPF\ soot} \underbrace{\left[C[NO_2]^{\beta} T^{\gamma} e^{\frac{-E}{RT}}\right]}_{\substack{global\ soot/NO2\ reaction \\ rate}} \quad \text{Eq. 2}$$

m=Soot mass

C=constant

[NO2]=concentration of $NO_2$ in the DPF participating in the reaction

T=reaction temperature

E=activation energy

R=universal gas constant alpha, beta, gamma are exponents

The regeneration process is primarily comprised of surface reactions between non-uniformly distributed solid and gaseous reactants which must additionally (typically) be in contact with a catalyst. Therefore, the likelihood of a mobile oxygen-bearing gas molecule (rapidly) locating an immobile (and non-uniformly distributed) soot particle that is also in the presence of an immobile solid catalyst will increase as soot density increases. Therefore, more reactions will be occurring at once as soot load density increases. This is true for most, if not all, kinetically limited regeneration processes. The inventors recognize that this is true for most, if not all, diffusion limited reactions where the limiting reactant is recycled. The recycling phenomenon is illustrated schematically in FIG. 1, which shows NO reacting with O2 in the presence of a catalyst 10 on a DPF 11 to form NO2; the NO2 reacting with soot 12 on the DPF to form, e.g., NO+CO+CO2; the NO reacting again with O2 in the presence of the catalyst to form NO2, etc., until the NO or NO2 exits the system. The inventors recognize that it is generally not true that more reactions will be occurring at once as soot load density increases for a diffusion limited reaction with abundant soot where the limiting reactant cannot be or is not recycled. In this case, all of the limiting reactant is already consumed and will not be reused; therefore the maximum number of reactions is already occurring. Consequently, methods according to aspects of the present invention have advantages over conventional NO2-based methods, namely that regeneration efficacy and NOx efficiency will increase significantly as the soot load increases.

NOx present in diesel exhaust gas is comprised primarily of NO, with only a small portion of NO2. Therefore, in a passive regeneration system a catalyzing agent, such as a Diesel Oxidation Catalyst (DOC), is typically used to form NO2 from NO.

Figure 2:
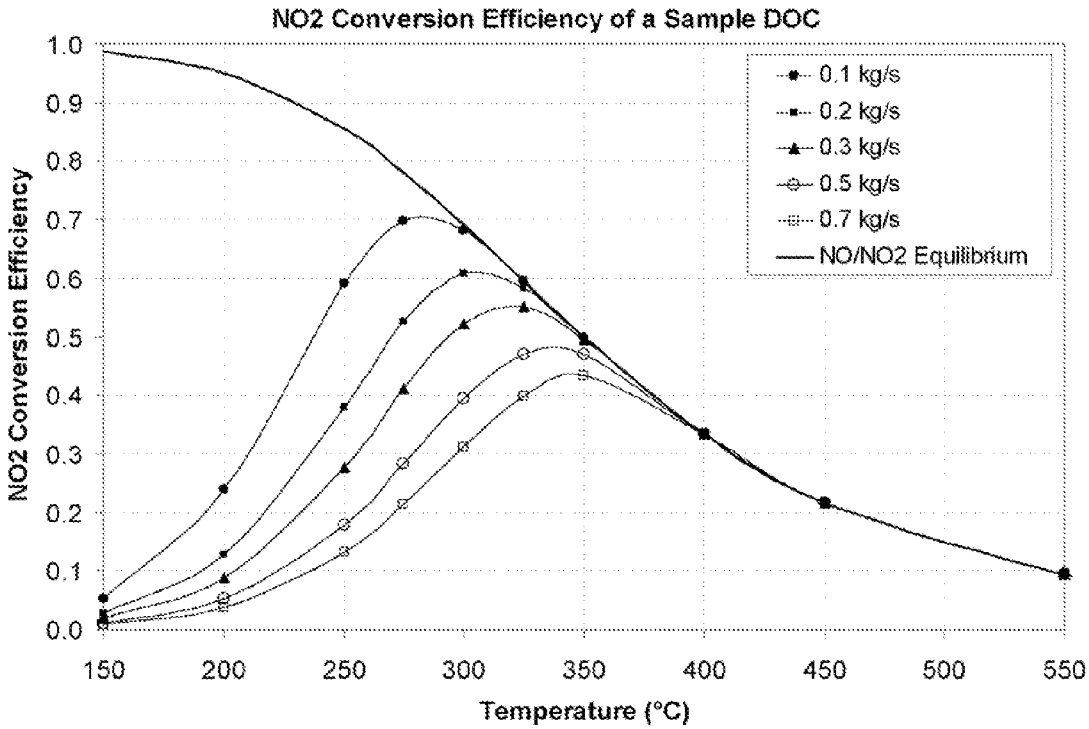
FIG. 2 is a graph of NO2 conversion efficiency versus temperature for a sample Diesel Oxidation Catalyst (DOC) at various exhaust mass flow rates showing an equilibrium line above which NO2 converts to NO.

It is ordinarily desirable to increase the passive NO2-based regeneration activity achievable for a given NOx quantity by increasing the NO2/NO ratio, thereby increasing the total NO2, or reactant, quantity. In other words, it is ordinarily desirable to increase the reaction rate of soot in the DPF by increasing the supply of the limiting reactant, NO2. However, as seen in FIG. 2, for a given exhaust mass flow, the efficacy of the catalyst at converting NO to NO2 initially increases with increasing temperature, before it starts to decrease and eventually falls along the NO-NO2 equilibrium line. Once the equilibrium line is followed, the NO2 supply is at the equilibrium limit. The actual measured NO2 supply, which will be equal to or less than the equilibrium limit, shall be referred to as the "equilibrium-limited NO2 supply".

The equilibrium-limited NO2 supply will, pertain to systems with and without catalyzing agents upstream of the DPF. In the case of a system with an effective catalyzing agent upstream of the DPF, the equilibrium-limited NO2 supply will refer to the actual NO2 quantity which is formed upstream of and passed into, the DPF. It is understood that for systems with a catalyzing agent upstream of the DPF, that the catalyzing agent must, during a regeneration event, be effective to substantially increase the NO2 supply of the NOx containing gas; otherwise, for the purposes of determining the equilibrium-limited NO2 supply, the system is considered to have no catalyzing agent upstream of the DPF. The catalyzing agent is considered to be not effective to substantially increase NO2 supply during the regeneration event if the NO2 quantity available from the catalyzing agent to the DPF is significantly less than the NO2 quantity exiting the DPF when no NO2 participates in a soot oxidation reaction, such as in the case of a DPF with no soot present. In the case of a system with no catalyzing agent upstream of the DPF, and in which NO2 is formed in a catalyzed DPF, the equilibrium-limited NO2 supply will refer to the NO2 quantity which is passed out of the DPF when no NO2 participates in a soot oxidation reaction.

During a passive NO2-based regeneration, the soot oxidation reaction may be either kinetically controlled or diffusion limited. In the case of a fully loaded DPF, the type of limit depends on the reactant temperature as well as on the amount of NO2 supplied to the reaction.

A kinetically controlled NO2/soot reaction implies that not all of the NO2 which is passed through the DPF can be reacted while it is still within the DPF, and is therefore "wasted". Unlike O2 in the case of an active O2-based regeneration, NO2 (and NOx) are regulated emissions, and therefore unnecessarily producing NO2 that will not participate in soot regeneration should be avoided.

Alternatively, a diffusion-limited NO2/soot reaction implies that the supplied NO2 quantity is less than that which could be reacted within the given residence time at the prevailing temperature. Similarly, if the reaction is diffusion limited by soot, this implies that the DPF soot loading is low. The time that the reactant (NO2) spends within a reactor (DPF) is called the residence time. In the case of a diffusion limited reaction, soot regeneration could be completed faster with an increased NO2 supply. In a passive NO2-based regeneration event, the optimum NOx quantity would be that which would produce an equilibrium-limited NO2 supply that would approximately match the kinetic reaction rate at the prevailing temperature. Therefore, the reaction would approach a balance point, between kinetic control and diffusion limitation. Active NO2-based regeneration concepts that actively control reactant temperature and/or supply and/or residence time with this objective may be devised. These approaches, whether implemented passively or actively, will be referred to herein as "conventional" NO2-based regeneration concepts. Conventional NO2-based regeneration concepts will optimally seek to approach a balance point between kinetic and diffusion limitation, thereby maximizing the NO2/soot reaction rate.

Whether recognized or not, conventional NO2-based regeneration methods seek to increase soot regeneration efficacy and/or efficiency by optimally increasing the NO2 percentage of the NOx quantity ("NO2 percent") supplied to the reaction and/or optimally regulating reactant temperature, to the extent that a balance point between a kinetically controlled and diffusion limited soot oxidation reaction is achieved. Where conventional methods seek to increase the NO2 percent supplied to the reaction, this is achieved by increasing either the NO2 percent supplied to the DPF or alternatively the potential equilibrium NO2 percent within the DPF, where potential equilibrium NO2 percent is determined by the combined NO and NO2 supply to the DPF, the prevailing conditions within the DPF and by the NO-NO2 equilibrium relationship.

The inventors recognize that methods according to aspects of the present invention can achieve soot regeneration efficacy and efficiency greater than conventional methods. The inventors recognize that the quantity of NO2 which is reacted with soot can be much greater than the quantity of NO2 which is supplied to the reactor (the DPF). Furthermore, the inventors recognize that the quantity of NO2 reacted with soot within a given period of time can be even greater still than the theoretical equilibrium quantity of NO2 which would pass through the reactor within the same period of time. Methods according to aspects of the present invention increase the quantity of NO2 which is reacted with soot by increasing the soot oxidation reaction rate and the NO oxidation reaction rate, even as this may cause the NO2 concentration supplied to the DPF and the equilibrium NO2 concentration within the DPF to decrease. In doing so, methods according to aspects of the present invention can greatly increase the benefit of the NO recycling mechanism to the soot regeneration process, thereby recognizing significantly higher soot regeneration efficacy and efficiency than conventional NO2-based methods.

Aspects of the present invention do not necessarily seek to maximize the equilibrium-limited NO2 supply or establish a soot oxidation reaction that is approximately balanced between kinetic control and diffusion limitation. Nor do aspects of the invention necessarily seek to actively extend (through thermal, volumetric flow or reactant supply management) the engine operating range where conventional NO2-based regeneration may occur. Instead, the concept of an "effective NO2 supply" is introduced, which effective supply will be enhanced to increase its soot removal efficacy relative to the efficacy that would be expected during conventional NO2-based regeneration, even if the equilibrium-limited NO2 supply is decreased. The effective NO2 supply is defined for purposes of the present application as the amount of NO2 that participates in soot oxidation. The participating NO2 can either come directly from the equilibrium-limited NO2 supply, NO oxidized in the catalyzed DPF, or from NO recycling. The concept of the soot removal capacity of the NO2 reactant is also introduced. Even though the method employed can cause the equilibrium-limited NO2 supply to decrease, it can at the same time greatly increase the effective NO2 supply, thereby increasing the soot removal capacity of the equilibrium-limited NO2 supply, resulting in a significantly higher soot oxidation rate. Conditions can be controlled so that, even though a lesser quantity of NO2 is supplied to the DPF than under conventional conditions, the rate at which NO is converted to NO2 and that NO2 reacts with soot within the DPF is greater than under the conventional conditions where a larger quantity of NO2 is supplied to the DPF. In aspects of the present invention, the NO is effectively "recycled", usually more than once, through a catalytic reaction to form NO2, which in turn, reacts with soot, again forming NO which is catalytically reacted, etc. Thus, a particular quantity of NOx in the engine exhaust, under conditions controlled according to aspects of the present invention, can be effective to oxidize more soot than an equilibrium-limited NO2 supply. This aspect of the invention will be referred to herein as "active NO2-based regeneration (of a DPF) with enhanced effective NO2 supply". The available NO2 quantity during a conventional active NO2-based regeneration can be determined primarily by the total allowable NOx quantity (as determined by the application) and the equilibrium NO-NO2 ratio for a given set of operating conditions (including those being actively controlled). The implications of the differing objectives of conventional NO2-based regeneration concepts and the concept set forth are significant, both in application of the concept (the method and apparatus) and its efficacy and efficiency.

The activation energy required to initiate an O2/soot reaction is significantly higher than that required for the NO2/soot reaction. Due to the higher activation energy required for the O2/soot reaction, the current state of the art in catalyst technology has not demonstrated the ability to achieve practical passive O2-based regeneration of soot under the normal operating conditions of a diesel engine. In practice, effective O2-based regeneration has only been achieved actively at temperatures above about 600° C. Therefore, to those familiar with regeneration of DPFs, the concept and implementation of "active" regenerations has generally been for O2-based regenerations, and the terms have been used interchangeably. Likewise, the concept and terminology of "passive" regeneration and NO2-based regeneration have generally been widely used interchangeably, although a distinction should be made. The subject invention identifies the concept of, and establishes a method and apparatus for, active "recycled" NO2-based regeneration with significantly more soot removal efficacy and improved total NOx efficiency than a conventional NO2-based regeneration, whereby soot removal efficacy comparable to or exceeding that of an active O2-based regeneration can be achieved at significantly reduced exhaust temperatures, as well as allowing for higher DPF soot loadings and the ability to be applied over a wider operating range than active O2-based regenerations. NOx efficiency shall be expressly defined as the mass of soot removed (gC) by the mass of NOx (gNOx) supplied to the DPF over a time period that is significant with respect to, but not exceeding, the time required to effectively regenerate a substantially full DPF. The unit "gC" is the mass of soot removed from the DPF and the unit "gNOx" is the mass of the accumulated NOx supply. The DPF is considered to be substantially full when the DPF soot load is at least 90% of the soot load at which regeneration ordinarily will be initiated in the system under consideration. The DPF is considered to be effectively regenerated once a significant soot removal rate is not maintained. A significant soot removal rate is determined with respect to the soot removal rate during a substantial portion of the soot removal. A substantial portion of the soot removal can be considered to be approximately 50% of the total soot removed.

In contrast to previous regeneration concepts, aspects of the present method and apparatus seek to actively maximize NO2-based regeneration through a combination of active thermal management of the reactants, embodied here through thermal management of the DPF, in combination with active control of NOx production, allowing for the possibility of active manipulation of the volumetric flow (and therefore residence time) of the NO2 reactant, in order to enhance the soot removal capacity of the NO2 reactant. By contrast, conventional NO2-based regeneration concepts primarily seek to increase total NO2 reactant quantity through use of catalyzing agents and/or less commonly active control of NOx production, to levels appropriate for the prevailing reactant temperature, or alternatively to actively extend, through thermal and volumetric flow control, the operating regime where conventional NO2-based regeneration can occur.

The active NO2-based regeneration with enhanced effective NO2 supply method and apparatus sets forth the concept of and primarily seeks to maximize the soot removal capacity of the NO2 reactant, even though the NO2/NO ratio and therefore the equilibrium-limited NO2 supply decreases. In practice, this will ordinarily mean that the NO2/soot reaction will be diffusion limited, primarily due to the significantly higher kinetic term of the reaction rate than is the case for a conventional NO2-based regeneration.

Each C atom captured within the DPF may participate in an oxidation reaction with one NO2 molecule ($C+NO_2 \rightarrow CO+NO$), or alternatively with two NO2 molecules ($C+2NO_2 \rightarrow CO_2+2NO$). Based on the molar masses of NO2 (46.01 g/mol) and C (12.01 g/mol), this reaction stoichiometry dictates that the mass of soot reacted will be between ~13% (for 1:2 molar reaction) and 26% (for 1:1 molar reaction) of the mass of NO2 reacted. It is recognized that particulate matter is comprised primarily of soot, commonly empirically represented as C8H, and less significantly of unburned HCs and inert matter. Therefore, it will be reasonably assumed that the change in DPF soot loading over the course of regeneration is attributable primarily to the removal of C. For the purposes of calculations made herein, the change in DPF soot mass shall be assumed to be attributed solely to removal of C.

In the case of a catalyzed DPF passively regenerating with NO2, over the normal temperature and residence time range within the DPF, the best case will typically be that any given NO2 molecule, or an NO molecule which is first oxidized into NO2, is able to complete, on average, as few as less than one soot oxidation reaction before exiting the DPF. This is primarily due to the fact that during conventional operation increased DPF and soot temperatures are typically achieved at reduced residence times (i.e., at high exhaust mass flows and temperatures), where the NO2 has less time to react. Likewise, at longer residence times (lower mass flows and temperatures), increased DPF and soot temperatures are not achieved.

In NO2-based regeneration testing, a measurement of NO2 efficiency, which is related to the reaction stoichiometry of NO2 and C, is introduced to evaluate the effectiveness of a particular method. The NO2 efficiency is expressly defined as the mass of C removed from the DPF divided by the mass of NO2 provided to the DPF, determined over a time period that is significant with respect to, but not exceeding, the time required to effectively regenerate a substantially full DPF. The DPF is considered to be substantially full when the DPF soot load is at least 90% of the soot load at which regeneration ordinarily will be initiated in the system under consideration. The DPF is considered to be effectively regenerated once a significant soot removal rate is not maintained. A significant soot removal rate is determined with respect to the soot removal rate during a substantial portion of the soot removal. A substantial portion of the soot removal can be considered to be approximately 50% of the total soot removed.

By defining NO2 and NOx efficiencies over a time period that is significant with respect to the time required to effectively regenerate the DPF, it is intended to exclude measurements calculated on the basis of transient occurrences and or reflecting regenerations that continue past the point at which a significant soot removal rate is no longer maintained. In testing, some of the regenerated soot will have been supplied from the incoming exhaust, and the associated regeneration reaction will not have decreased the DPF soot loading. This will, among other factors, decrease the measured NO2 efficiency. Conventional wisdom for conventional NO2-based regeneration dictated that NO2 efficiency would not significantly exceed 12.01 gC/46.01 gNO2=~0.26 gC/gNO2. The unit "gC" is the mass of soot removed from the DPF and the unit "gNO2" is the mass of the accumulated equilibrium-limited NO2 supply. Even more so, it was assumed that at elevated temperatures (near or just beyond the NO-NO2 conversion plateau as seen in FIG. 2) total NO2-based soot oxidation activity would fall significantly as the increasingly smaller equilibrium-limited NO2 supply would not be able to take advantage of the increased temperatures. In other words, increasing temperatures would simply lower NO2 supply and result in a more diffusion-limited reaction, therefore lowering the reaction rate, and thereby achieving lower total soot removal. Conventional passive NO2-based regenerations have NO2 efficiencies considerably less than 0.52 gC/gNO2, and more commonly less than 0.26 gC/gNO2, over a time period that is significant with respect to, but not exceeding the time required to regenerate a substantially full DPF.

However, it is precisely by actively increasing reactant temperature that an aspect of the method set forth is able to achieve significantly better soot removal results than conventional NO2-based regeneration techniques, with NO2 efficiencies of well above 0.52 gC/gNO2. This method allows for NO2 efficiencies of multiple times higher than 0.52 gC/gNO2. This is achieved by increasing the soot removal capacity of the NO2, with the objective of enhancing the effective NO2 supply (and not necessarily the equilibrium-limited NO2 supply). The mechanism whereby the soot removal capacity of the NO2 is increased is the NO recycling mechanism. The inventors have recognized that, within a catalyzed DPF given sufficiently long residence times and sufficiently high temperatures, an NO2 molecule which has reacted with soot and formed an NO molecule may then be recycled back into NO2, which may in turn participate in another soot oxidation reaction. This process may repeat itself as many times as the residence time, kinetic reaction rates of the soot oxidation and the NO oxidation reactions, soot availability, oxygen availability, and catalyst availability will allow.

It should be noted that the metric "NO2 efficiency" could also be defined in terms of moles C removed per moles NO2 provided. However, because NO2 efficiency is used here primarily as a metric to compare the performance of conventional passive NO2-based regenerations with active NO2-based regenerations with enhanced effective NO2 supply, whether it is expressed in terms of gC/gNO2 or in terms of moles C/moles NO2 is not presently believed to be significant. It is noted that during a conventional passive NO2-based regeneration, there may well be recycling of NO, but the amount of recycling will be significantly lower than that which is achieved via active NO2-based regeneration with enhanced effective NO2 supply.

Further, the NO2 efficiency metric assumes that, where a catalyzing agent is provided upstream of the DPF, the catalyzing agent is an effective catalyzing agent. An effective catalyzing agent is considered to be one that can raise NO2 levels substantially to maximum possible equilibrium levels for the conditions of the gas in question. To assume otherwise presents the risk that, during a conventional passive NO2-based regeneration, an ineffective upstream catalyzing agent could deliver low levels of NO2 and regeneration of the DPF would be largely a function of conversion of NO to NO2 in the DPF and indicate a high NO2 efficiency without achieving soot removal efficacy according to aspects of the present invention. The models and examples described here assume that any upstream catalyzing agent is an effective catalyzing agent. For any system, i.e., one with an effective upstream catalyzing agent, one with an ineffective upstream catalyzing agent, and one with no catalyzing agent, the equilibrium-limited NO2 supply can also be considered to refer to the NO2 quantity that is passed out of the DPF when no NO2 participates in a soot oxidation reaction, such as in the case of a DPF with no soot present.

By actively increasing temperatures (and to the extent possible residence time), the method set forth seeks to maximize the advantage offered by the NO recycling mechanism. Some effect can be achieved through various methods of increasing the residence time, however, in a conventional powertrain arrangement this will largely be dictated by the engine operating point (speed and load), and therefore the ability to reduce residence time will be limited. Maximizing how many times an NO2 molecule is recycled will primarily be achieved by increasing the kinetic term of the NO oxidation reaction through thermal control of the reactant. Because the number of NO recycles will increase faster with temperature than the equilibrium-limited NO2 supply will fall, the effective NO2 supply can be increased even as the equilibrium-limited NO2 supply decreases.

In practice, the optimal temperature for active NO2-based regeneration with enhanced effective NO2 supply will typically be the maximum temperature which is allowed. This maximum temperature may be a temperature with accepted safety margin from a temperature at which runaway O2-based regenerations could occur, component temperature limits, etc., and the like, most of which will vary from system to system. Note, however, that if operating conditions are such that a maximum practical limit on NO recycles is achieved at a given temperature, then further temperature increases will in fact decrease the effective NO2 supply. The maximum practical limit on NO recycles may be affected by factors such as DPF design and physical characteristics of the DPF wall. Also note that the method used to raise DPF temperatures may affect regeneration performance. Specifically, for systems that combust hydrocarbons (HCs), including catalyzed combustion systems, excessive HC slip into the DPF may negatively impact the NO recycling process. In this case, under operating conditions where increases in DPF temperature will result in substantially increased HC slip to the DPF, regeneration performance may be negatively impacted.

When not limited by other constraints, the maximum allowable temperature will be one that approaches, but maintains an adequate safety margin from, a temperature which would trigger an uncontrolled O2-based regeneration. The temperature required to trigger an uncontrolled O2-based regeneration will decrease as a function of catalyst characteristics and increasing soot densities. In practice, a DPF inlet temperature of less than or equal to about 550° C., or less than or equal to about 500° C. has been used to ensure both that an uncontrolled O2-based regeneration is not initiated and that a highly effective active NO2-based regeneration with enhanced effective NO2 supply is achieved. Higher temperatures may be used, with improved soot removal results, as long as an uncontrolled O2-based regeneration is not triggered. If necessary, lower temperatures may also be used, although a decrease in soot oxidation performance may be observed.

Ordinarily, when applying methods according to aspects of the present invention, soot oxidation will be maximized when the input NOx flow is optimally increased. Therefore, constraints placed upon the maximum allowable NOx flow will decrease the soot removal performance—that is, how much time is required to regenerate the DPF from a given starting soot loading down to a given end soot loading. However, decreasing the input NOx quantity will not significantly decrease the NOx efficiency, because the amount of input NOx will not significantly affect the NO recycling mechanism. Conceptually stated, decreasing the total NOx flow will decrease the effective NO2 supply flow, but it will not decrease the soot removal capacity of the NO2 reactant. This means that approximately the same total NOx quantity will be required to regenerate a given soot quantity, it will simply require a longer regeneration event. Therefore, the total NOx quantity required from the engine to regenerate a given soot quantity using aspects of the present invention is still significantly less than what would be required for a conventional NO2-based regeneration event.

It should be noted that additional energy must be expended in order to actively increase reactant temperature. Therefore, the least costly active NO2-based regeneration with enhanced effective NO2 supply will be the one which is completed in the shortest amount of time (that is at the highest allowable temperature, longest possible residence time, and highest allowable input NOx quantify). The regeneration performance of an active NO2-based regeneration with enhanced effective NO2 supply may be limited in its ability to generate significant NOx quantities by base engine constraints such as maximum allowable cylinder pressure. Likewise, the ability to initiate an active NO2-based regeneration with enhanced effective NO2 supply may be limited by the ability to actively regulate reactant temperature, such as DOC systems that require a minimum catalyst temperature.

NOx aftertreatment devices, such as SCR, are not required for implementation of the method, but will allow for complete or partial reduction of elevated NOx levels exiting the DPF. NOx production (as well as manipulation of mass flow) can be accomplished through engine controls (including injection timing, injection pressure, turbocharger vane position, and EGR valve position). An alternative control strategy designed for optimal (or maximum allowable) NOx production, exhaust gas temperature and DPF residence time during an active NO2-based regeneration with enhanced effective NO2 supply can be implemented and triggered by an ECU. An aftertreatment hydrocarbon injector can inject fuel upstream of the DOC. The injected fuel is oxidized over the DOC, raising the exhaust gas temperatures, and thereby raising the temperature of the DPF and the captured soot. Additionally, the DOC produces an NO2 supply from the input NOx quantity. The NO2 quantity produced in the DOC is then passed into the DPF, where soot oxidation is carried out according to the method and mechanism identified above.

It should be observed that NO2 may be formed from an NO molecule once within the DOC. However, due to the NO recycle mechanism, NO2 can be reformed from an NO molecule numerous times within the catalyzed DPF, as illustrated in FIG. 1. Because the bulk of the effective NO2 production happens within the DPF for aspects of the present invention, a DOC is not required. Therefore, any system with a catalyzed DPF that is additionally capable of actively regulating reactant temperatures, such as burner systems, electrical heating systems, microwave systems, etc., can be used for implementation of the method. The illustrated system used to explain and describe the concept and method is not intended to be representative of all systems on which the method may be implemented.

The current state of the art in catalyst technology has enabled conventional NO2-based regeneration under certain elevated exhaust temperature operating regimes of a diesel engine, but with less efficacy than that which has been demonstrated for active O2-based regeneration. Therefore, in many applications, reliance solely upon conventional NO2-based regeneration is not sufficient to meet the required soot removal levels, and either active O2-based regeneration or a combination of active O2-based and conventional NO2-based regeneration has been employed. However, due to the exothermic and kinetically controlled nature of the O2/soot reaction, constraints are needed to avoid runaway O2-based regeneration. Particularly, requirements of a minimum exhaust mass flow and maximum allowable DPF soot loading must be observed. The minimum exhaust mass flow constraint increases the likelihood of an incomplete regeneration occurring when implemented in practice. The maximum DPF soot loading will determine, among other things, how frequently DPF regenerations are required.

Due to the diffusion limited nature of the active NO2-based regeneration with enhanced effective NO2 supply method, runaway NO2-soot oxidation reactions do not occur. It is possible, via aspects of the present invention, to initiate an uncontrolled O2-based regeneration. However, the exhaust mass flow constraint is lessened via aspects of the active NO2-based regeneration with enhanced effective NO2 supply method and apparatus. Likewise, the DPF soot density necessary to initiate an uncontrolled O2-based regeneration is significantly raised via aspects of the present invention. Higher allowable DPF soot loading levels allow for less frequent regenerations. In certain applications, higher allowable DPF soot loading levels may result in an equilibrium soot loading level being reached that is lower than the maximum DPF soot loading level, but higher than that which would be allowed in O2-based regeneration systems. Therefore, in these applications under normal circumstances, no active regenerations would be required. However, should the DPF loading continue to rise above the expected equilibrium due to atypical operation, component failure or other causes, it could still be safely regenerated with an active NO2-based regeneration with enhanced effective NO2 supply, which would not be possible with an O2-based regeneration.

Further, active NO2-based regeneration with enhanced effective NO2 supply can be achieved at significantly lower temperatures than an O2-based regeneration of equivalent efficacy, thereby decreasing the negative performance impact on, and the likelihood of damaging, relevant exhaust aftertreatment devices. This will include components downstream of the soot filtration and regeneration system, such as an SCR.

Figures 3A, 3B:
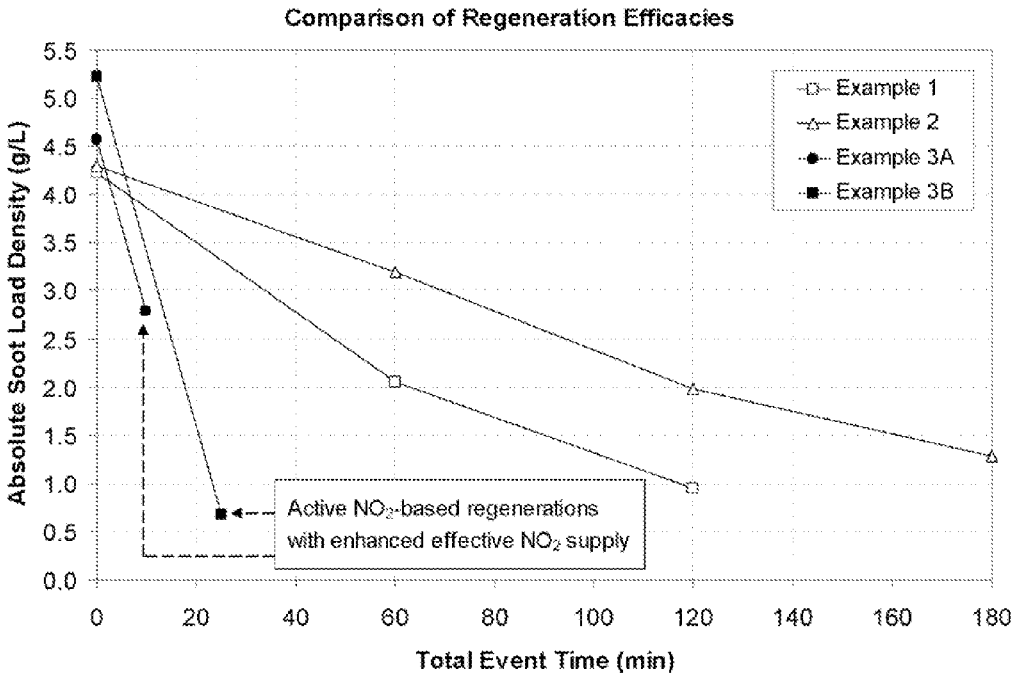
FIG. 3A is a graph of Soot Load versus Regeneration Time comparing conventional NO2-based regenerations with an active NO2-based regeneration with enhanced effective NO2 supply according to an aspect of the present invention.
FIG. 3B is a Table of data shown graphically in FIG. 3A.

FIG. 3A graphically illustrates examples of conventional NO2-based regenerations and examples of active NO2-based regenerations with enhanced effective NO2 supply. Examples 1 and 2 illustrate regeneration results using conventional NO2 methods, while Examples 3A and 3B illustrate regeneration results using aspects of the present invention. Total event time for the regenerations shown graphically in FIG. 3A is shown in the Table in FIG. 3B. The total event time for these regenerations included time spent warming up the test systems and, thus, NOx and NO2 efficiencies shown in Table 1 below are likely marginally lower than they would have been if NOx and NO2 quantities were measured only over the period after normal conditions for regeneration had been reached. However, if the warm-up period were not included, it is expected that the differences between the conventional NO2-based regenerations of Examples 1 and 2 and the active NO2-based regenerations with enhanced effective NO2 supply of examples 3A and 3B would be even more dramatically favorable.

The tests described in Examples 1, 2, 3B, and 3B were all conducted on an engine dynamometer, and the engine was operated at the same engine speed and brake torque. Also, the same equipment was used for each test. The engine was a US2010 Volvo MD11L B-Phase Heavy-Duty Diesel Engine, the exhaust aftertreatment system was a Fleetguard B-Phase DOC and DPF for Volvo US2010 MD11. The DOC and the DPF included a precious metal oxidation catalyst; and the heating arrangement used was HC injection over a DOC.

Test methodology was as follows for soot load measurement. The engine was operated through a predetermined soot loading routine to load the DPF. The DPF was weighed hot to avoid moisture absorption errors and the starting soot loading was calculated. The DPF was re-installed and the desired method of regeneration was performed for a measured length of time. Immediately following the regeneration, a hot weight was recorded, the new soot loading was calculated and the change in soot load was determined. At this point, for Examples 1 and 2, one or two additional regenerations, respectively, were performed, and the soot loading after each regeneration was measured. Once the desired number of regenerations was completed, the DPF was regenerated for an extended period of time using a high efficacy method.

Table 1 shows a summary of the key statistics for the four Examples: Removed soot mass, Accumulated NOx and NO2, Calculated NOx and NO2 efficiencies, and Total fuel consumed. NOx and NO2, at the DPF inlet, were integrated to determine the accumulated NOx and NO2 quantities used in the NOx and NO2 efficiency calculation. In order to determine accumulated NO2, the DOC NO2 conversion efficiency was modeled for all Examples in order to determine NO2 as a percentage of NOx, herein referred to as NO2 percent. Additionally, in a test replicating the conditions of Examples 3A and 3B, the NO2 was measured to confirm the unexpected results achieved in Examples 3A and 3B.

TABLE 1

Summary of key statistics

| | | Soot Mass Removed g | Acc. NO*x* g | Acc. NO2 g | NO*x* Efficiency gC/gNO*x* | NO2 Efficiency gC/gNO2 Modeled/Measured | Fuel Cons. kg |
|---|---|---|---|---|---|---|---|
| Example | 1 | 73.0 | 473.3 | 236.7 | 0.15 | 0.31 | 21.37 |
| | 2 | 67.0 | 976.2 | 635.0 | 0.07 | 0.11 | 28.42 |
| | 3A | 39.5 | 100.3 | 18.0 | 0.39 | 3.03/2.19 | 1.83 |
| | 3B | 101.0 | 356.3 | 63.8 | 0.28 | 2.18/1.58 | 4.79 |

In Examples 1 and 2 the engine was calibrated to increase NOx production and, as much as possible, to raise exhaust gas temperature without the aid of HC injection. There is a trade-off between NOx production and exhaust gas temperature. For Example 1, the trade-off was made towards a higher exhaust gas temperature, whereas Example 2 was biased towards higher NOx mass flow. The resultant DPF inlet temperatures in Examples 1 and 2 ranged from approximately 350-390° C. with an average DPF temperature of approximately 325-375° C.

These average DPF temperatures approximate what would be seen in typical passive NO2-based regeneration while driving, at least over some portion of a typical duty cycle. In order to make steady-state tests that can be more easily analyzed, the Examples are understood to represent a fair comparison between conventional methods and active NO2-based regeneration with enhanced effective NO2 supply.

Examples 3A and 3B show active NO2-based regeneration with enhanced effective NO2 supply being conducted for two different regeneration durations. In Examples 3A and 3B the engine was calibrated to increase NOx further than Example 2. In addition, HC injection over the DOC was used to control the DPF inlet temperature to approximately 490° C., resulting in an average DPF temperature of approximately 470° C. It will be seen from a comparison of Examples 1, 2, 3A, and 3B that regeneration via what is referred to here as conventional techniques (Examples 1 and 2) tends to be slower than active NO2-based regeneration with enhanced effective NO2 supply (Examples 3A and 3B). Moreover, the NOx efficiency and the NO2 efficiency of active NO2-based regeneration with enhanced effective NO2 supply tends to be substantially greater than the NOx efficiency and the NO2 efficiency of conventional techniques.

Figure 4:
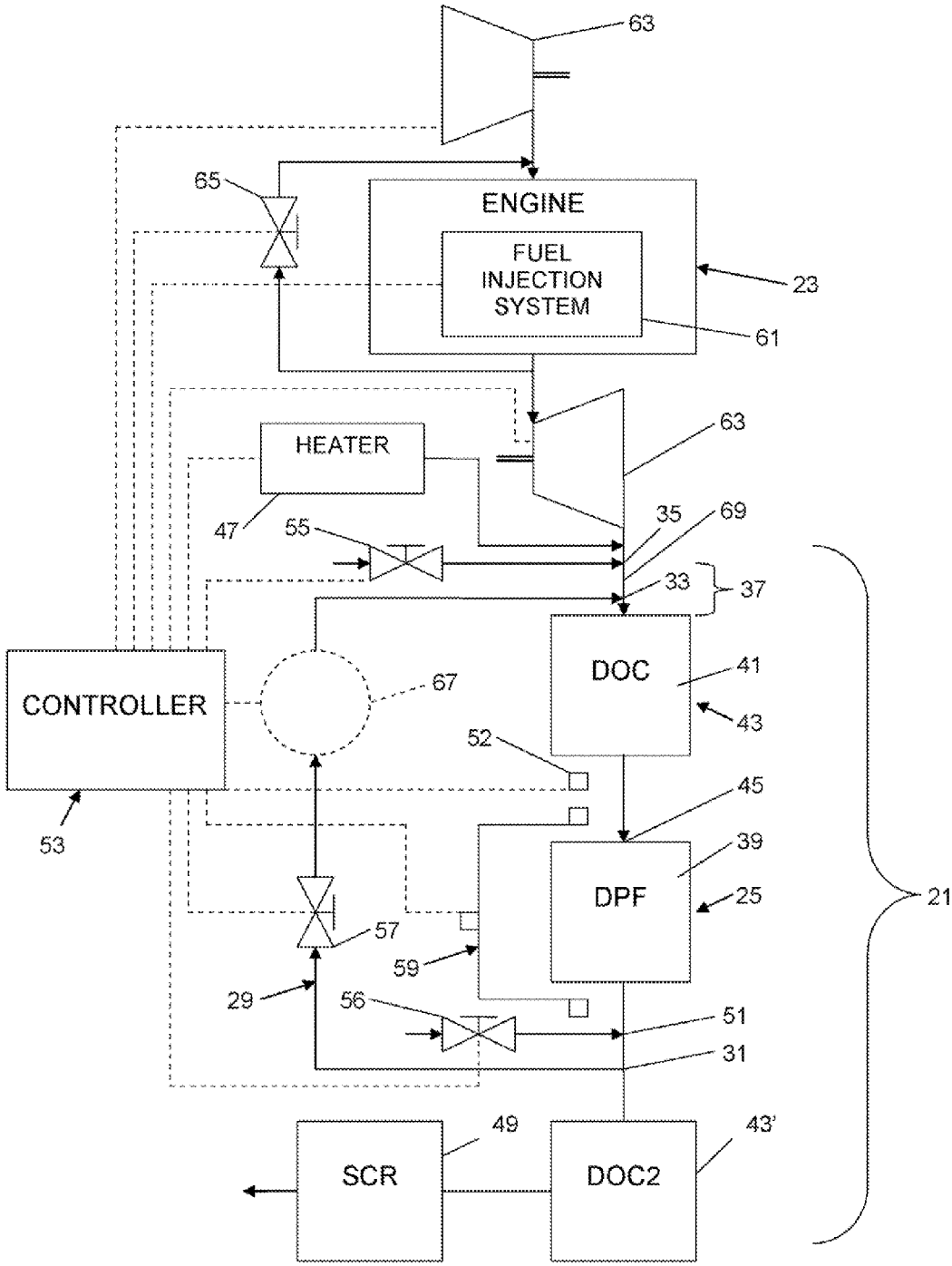
FIG. 4 schematically shows an exhaust aftertreatment system according to an aspect of the present invention.

An exhaust aftertreatment system (EATS) 21, particularly useful in connection with a diesel engine 23, is shown in FIG. 4. The EATS 21 comprises a diesel particulate filter (DPF) 25 downstream of the diesel engine 23. The DPF 25 is arranged to receive an exhaust gas stream from the engine 23.

To perform active NO2-based regeneration with enhanced effective NO2 supply, a diesel engine arrangement can comprise the diesel engine 23 arranged to introduce a NOx containing gas into a catalyzed DPF 25. The mass flow of the NOx containing gas can be controlled in any suitable manner, such as by variable valve timing, cylinder deactivation, or use of non-conventional powertrain arrangements. In active NO2-based regeneration with enhanced effective NO2 supply, the NOx level at the inlet of the DPF 25 is controlled, ordinarily by adjusting local flame temperature in cylinders of an engine upstream of the DPF. Additionally, a heating arrangement 47 can be arranged to control a temperature of at least one of the DPF 25, the NOx containing gas, and/or the soot in the DPF. A controller 53 can be arranged to control the heating arrangement to assist an active NO2-based regeneration with enhanced effective NO2 supply by controlling the temperature so that the NOx containing gas reacts with the catalyst to form NO2 molecules, that thereafter react with soot particles to form CO, CO2, and NO molecules, and achieving a NO2 efficiency greater than 0.52 gC/gNO2, and more preferably greater than about 1.04 gC/gNO2.

The heating arrangement 47 can comprise a hydrocarbon injection arrangement arranged to control the temperature of at least one of the DPF 25 and the NOx containing gas by injecting a hydrocarbon into a diesel engine exhaust stream upstream of the DPF. The heating arrangement may comprise a catalyst, such as in the DPF 25 or in a DOC 43 upstream of the DPF for reacting with the hydrocarbon to increase exhaust gas temperature and/or to facilitate conversion of NO to NO2. The heating arrangement 47 may comprise a burner for burning the hydrocarbon. The heating arrangement 47 may be of a type that heats the DPF 25 instead of the NOx-containing gas stream, such as an electrical heating arrangement, or a microwave arrangement for heating the soot.

A conduit 29 can be provided for permitting recirculation of gas including recirculated NO and/or NO2 or both from a point 31 that is ordinarily downstream of the DPF 25 to a point that is ordinarily upstream 33 of the DPF. Recirculation of NO and/or NO2 can be useful during active NO2-based regeneration with enhanced effective NO2 supply, as well as during passive or active conventional NO2-based regeneration, and during O2-based regeneration. The expressions "downstream of the DPF" and "upstream of the DPF" of the DPF 25 are intended to include arrangements wherein the points 31 and 33 are remote from the DPF, as well as points on the DPF that are downstream or upstream of substantial portions of the DPF, i.e., the conduit 29 may connect directly to one or more points on the DPF so that the conduit connects at a first point downstream of the inlet of the DPF and another point downstream of the first point. Other arrangements are also possible, such as where an oxidation catalyst, such as a DOC, is provided upstream (DOC 43) or downstream (DOC2 43') of the DPF and recirculation could be from, e.g., a point between the inlet of the upstream oxidation catalyst and the outlet of the DPF to a point upstream of the takeoff point. If recirculation takeoff is from an oxidation catalyst DOC2 43' downstream of the DPF then recirculation is to a point upstream of the outlet of the DPF. In theory, recirculation could be from any takeoff point downstream of the inlet of the oxidation catalyst (if provided) or DPF to any point upstream of the takeoff point so that at least some NOx (NO2, NO for reaction with O2 to form NO2, and/or both) is recirculated.

A reaction region can be arranged to cause the recirculated NO to react with O2 to form NO2. The reaction region can comprise a region 37 including a point 35 at which air or O2 (hereinafter referred to as "air/O2") can be injected and mixes with the recirculated NO to form NO2. The reaction region can, in addition or in the alternative, comprise a region in which the recirculated NO reacts with O2 in the presence of a catalyst to form NO2. The region in which the recirculated NO reacts with O2 in the presence of a catalyst can be a region 39 in which the catalyst is in the DPF, however, the region in which the recirculated NO reacts with O2 in the presence of a catalyst can be a region 41 in which the catalyst comprises a diesel oxidation catalyst (DOC) 43 upstream of the DPF. The reaction region can comprise any one or more of the reaction regions 37, 39, or 41, as well as other regions in which NO can be caused to react with O2, the object of providing the region being simply to promote a reaction of NO with O2 to form NO2.

Air/O2 can be injected downstream of the DPF 25 and upstream of a downstream DOC2 43'. This may be useful, for example, to facilitate conversion of NO to NO2 in DOC2 43' so that the NO2 can be recirculated back to the DPF 25. Air/O2 can be injected anywhere in the exhaust aftertreatment system for the purpose of enhancing regeneration.

Recirculating NO2 or forming NO2 from the recirculated NO and thereafter using the NO2 to oxidize soot and form CO, CO2, and NO and thereafter recycling the NO to NO2, which will complete at least one further soot oxidation reaction to regenerate the DPF 25 shall be referred to herein as "active NO2-based regeneration (of a DPF) with enhanced effective NO2 supply using recirculated NOx". The method of recirculating NOx not only increases regeneration effectiveness, but does so without increasing the regulated system out NOx. It is contemplated that both NO recycling in a catalyzed DPF and NOx recirculation can be used together beneficially, such as to increase NO residence time in the DPF. Active NO2-based regeneration with enhanced effective NO2 supply (which must include a catalyzed DPF and need not involve NOx recirculation) and NO2-based regeneration using recirculated NOx (which need not involve a catalyzed DPF) are both to be contrasted with conventional NO2-based regeneration that seek to approach a balance point between kinetic and diffusion limitation. Active NO2-based regeneration with enhanced effective NO2 supply and NO2-based regeneration using recirculated NOx are also both to be contrasted with active O2-based regeneration in which substantially all soot is removed by reaction with O2 and which typically is performed at substantially higher temperatures (above about 600° C. to about 625° C. for a catalyzed DPF, and up to and sometimes in excess of 660° C. for an uncatalyzed DPF) than conventional NO2-based regeneration, active NO2-based regeneration with enhanced effective NO2 supply, or NO2-based regeneration using recirculated NOx. Active O2-based regeneration also typically involves heating of the exhaust stream at the inlet 45 of the DPF, such as with a heating arrangement 47 such as an aftertreatment hydrocarbon injector.

A NOx aftertreatment device such as a selective catalytic reduction aftertreatment device (SCR) 49 can be provided downstream of the DPF 25 to reduce NOx emissions. The reaction region 37 at which air/O2 is injected may be disposed downstream of the DPF 25 and upstream of the SCR 49, however, it will ordinarily be disposed upstream of the DPF and, if provided, a DOC 43. In some circumstances, however, it may be useful to inject air/O2 downstream of the DPF 25. The injection point 35 for the air/O2 can, alternatively, be downstream of the DOC 43 (if provided). The conduit 29, more particularly, the point 31 of the conduit downstream of the DPF 25, can be disposed downstream of the region 51 at which air/O2 is injected such that gas recirculated through the conduit can include at least some of the injected air/O2 which can react with recirculated NO to form NO2 for NO2-based regeneration using recirculated NOx.

A temperature monitor 52 can be provided and associated with a controller 53 such as one or more ECUs, which may comprise, for example, one or more computers or microprocessors, for controlling temperature of the DPF 25 or at the inlet 45 of the DPF. The temperature monitor 52 will ordinarily be disposed at, or upstream of, the inlet 45 of the DPF 25. Ordinarily, temperature during active NO2-based regeneration with enhanced effective NO2 supply is maintained at less than or equal to about 550° C., or less than or equal to about 500° C., and ordinarily it is maintained at least at 450° C. Where temperatures are described as being less than or equal to "about" some value, it will be understood that the temperature may exceed the particular value by a small amount, and some transient excursions may exceed the particular value by more than a small amount. The heating arrangement 47 may be controlled by the controller 53 to increase temperature to within the desired temperature range. If temperatures are above the desired range, appropriate cooling measures can be taken, such as introducing outside air/O2 at the injection region 37 by controlling a valve 55 via the controller 53. The controller 53 can also control a valve 56 in the air/O2 line 51 (if provided) downstream of the DPF 25, such as for controlling temperatures in the SCR 49 or for controlling mixing of recirculated NO with O2.

While the temperature ranges noted are approximate, above about 550° C., there is ordinarily an increased risk of runaway regeneration in a DPF with heavy soot loading. At temperatures less than or equal to about 550° C., it is presently theorized that less than two thirds, and possibly less than half, of the soot removed will be removed by reaction with O2 during active NO2-based regeneration with enhanced effective NO2 supply. Evaluation of the theoretical percentage of soot mass that is removed from the DPF by oxidation with O2 molecules in the gas to form CO and CO2 molecules (which shall also be referred to here by the shorthand term "O2 participation" in soot removal) must be done over a time period that is significant with respect to, but not exceeding, the length of an effective regeneration of a substantially full DPF. The DPF is considered to be effectively regenerated once a significant soot removal rate is not maintained. A significant soot removal rate is determined with respect to the soot removal rate during a substantial portion of the soot removal. A substantial portion of the soot removal can be considered to be approximately 50% of the total soot removed. The DPF is considered to be substantially full when the OFF soot load is at least 90% of the soot load at which regeneration ordinarily will be initiated in the system under consideration. For various reasons, it is recognized that what is presently theorized will tend to suggest higher O2 participation than actually occurs.

At temperatures less than or equal to about 550° C. if NOx levels at the inlet of the DPF are not controlled as occurs during active NO2-based regeneration with enhanced effective NO2 supply, a slower regeneration might be performed in which substantially all soot removal is due to reaction with O2. Control of temperature and control of NOx levels via active NO2-based regeneration with enhanced effective NO2 supply will ordinarily substantially increase regeneration efficacy.

It is also presently theorized that, ordinarily, when temperatures are raised sufficiently so that more than two thirds of the soot removed is removed by reaction with O2, the temperature will be approaching temperatures typically associated with lower temperature ranges of some O2-based regenerations, although in those O2-based regenerations, because NOx is not controlled as in active NO2-based regeneration with enhanced effective NO2 supply, substantially all soot removal is performed by O2. When NOx levels at the inlet of the DPF are controlled as for active NO2-based regeneration with enhanced effective NO2 supply and temperatures are raised sufficiently so that more than two thirds of the soot removed is removed by reaction with O2, DPFs that are heavily loaded with soot may be at risk for uncontrolled regeneration.

A useful, but not necessarily exclusive, technique for determining the percentage of soot mass that is removed from the DPF in any method, such as during active NO2-based regeneration with enhanced effective NO2 supply, through oxidation by O2 molecules in the gas to form CO and CO2 molecules, a.k.a., O2 participation, involves a series of empirical tests, particularly, a series of empirical regenerations, with each regeneration made over the same time period, which is significant with respect to, but not exceeding, the time required to effectively regenerate the DPF. The DPF shall be deemed to be effectively regenerated once a significant soot removal rate is not maintained. A significant soot removal rate is determined with respect to the soot removal rate during a substantial portion of the soot removal. A substantial portion of the soot removal can be considered to be approximately 50% of the total soot removed.

The contemplated technique for determining O2 participation proceeds as follows:

(A) The DPF is effectively cleaned. Various suitable methods for cleaning a DPF are known, and the particular method used to clean the DPF is not believed to be of particular importance, except that the method must produce reasonably consistent results and the same method should be used consistently.

(B) Subsequent to step (A), the DPF is loaded to at least 90% of the soot load at which regeneration ordinarily will be initiated in the system under consideration. The particular conditions under which and method by which the DPF is loaded should produce reasonably consistent results, and the same conditions and method should be used consistently.

(C) Subsequent to step (B), the DPF is regenerated via the method to be investigated ("investigative regeneration"), such as an NO2-based regeneration with enhanced effective NO2 supply, over a time period which is significant with respect to, but not exceeding, the time required to effectively regenerate the DPF. The total soot removal during the regeneration is measured.

(D) Subsequent to step (C), the DPF is again effectively cleaned.

(E) Subsequent to step (D), the DPF is loaded to the same starting soot load as during the investigative regeneration (or as close to that load as is reasonably possible).

(F) Subsequent to step (E), the DPF is then regenerated via a comparative regeneration method ("comparative regeneration") for a time equal to the time of the investigative regeneration. The comparative regeneration will be performed identically to the investigative regeneration, except that NOx levels at the input of the DPF have been decreased to levels that are insignificant with respect to the regeneration of the DPF. Upon completion of the comparative regeneration, the total soot removal is measured.

(G) The total soot removal via the comparative regeneration is divided by the total soot removal of the investigative regeneration to determine the maximum fraction of soot mass removed from the DPF through oxidation by O2 molecules in the gas to form CO and CO2 molecules during the investigative regeneration.

By defining O2 participation over a time period that is significant with respect to the time required to effectively regenerate, it is intended to exclude measurements calculated on the basis of transient occurrences and or reflecting regenerations that continue past the point at which a significant soot removal rate is no longer maintained.

The technique described is expected to over-estimate the actual fraction of the soot mass removed by O2 during the investigative regeneration and therefore is a conservative measure of O2 participation. More precise empirical and/or theoretical techniques may show even lower levels of O2 participation than are expected to be demonstrated by the method described above.

The controller 53 can also be arranged to stop and start recirculation of NOx through the conduit 29, such as by closing or opening a valve 57 in the conduit, so that NO2-based regeneration using recirculated NOx in which soot is oxidized at least in part by NO2 formed from or carried by the recirculated gas is stopped or started, and when NO2-based regeneration using recirculated NOx is stopped, so that a conventional or an active NO2-based regeneration with enhanced effective NO2 supply regeneration operation occurs in which soot is oxidized without recirculation. The valve 57 in the conduit 29 will ordinarily be adjustable to a plurality of positions including fully opened and fully closed, as well as to positions between fully opened and fully closed so that NO2-based regeneration using recirculated NOx can be completely stopped, partially stopped, or operated at maximum capacity. Adjustability of NO2-based regeneration using recirculated NOx can facilitate control of NOx production from the engine 23 and/or control of the rate of regeneration of the DPF.

The controller 53 can also be arranged to control the heating arrangement 47 to initiate an active O2-based regeneration operation wherein a temperature at the inlet 45 of the DPF 25 is increased sufficiently to oxidize soot in the DPF with O2 in the exhaust stream when the active NO2-based regeneration with enhanced effective NO2 supply or NO2-based regeneration using recirculated NOx is at least partially stopped. The methods can be at least partially stopped and an active O2-based regeneration can be initiated, such as by increasing temperature at the inlet 45 of the DPF, increasing temperature of the DPF 25, or increasing temperature of the soot, when the soot loading level is sufficiently low.

A pressure sensor arrangement 59 can be arranged relative to the DPF 25 and can be adapted to send a signal corresponding to a pressure drop across the DPF to the controller 53. Pressure drop across the DPF 25 (together with volume flow through the DPF) often bears a relationship to soot loading of the DPF. Different regeneration schemes involving different methods of regeneration can be performed. For example, a regeneration scheme may be devised to perform different methods of regeneration depending upon the pressure drop across the DPF 25, or some other indicator of soot loading. At high soot loading levels, the temperatures typically associated with an O2-based regeneration may be sufficiently high to cause a runaway regeneration that could damage the DPF. Lower temperatures, relative to those associated with O2-based regeneration, and which are typically associated with an active NO2-based regeneration with enhanced effective NO2 supply, may still be sufficiently high to initiate runaway O2-based regeneration reactions that could damage the DPF when soot loading levels are higher still. At such high soot loading levels, a regeneration scheme might begin with a conventional NO2-based regeneration, i.e., an NO2-based regeneration having an NO2 efficiency less than 0.52 gC/gNO2, and then, after the pressure drop across the DPF 25 (or other measure of soot loading) indicates a lower soot load level, switch over to an active NO2-based regeneration with enhanced effective NO2 supply. Once indicated soot load has dropped further, an active O2-based regeneration might be initiated. During any of the conventional NO2-based regeneration, active NO2-based regeneration with enchanced effective NO2 supply, or active O2-based regeneration, NO2-based regeneration using recirculated NOx (involving recirculation of NO and/or NO2) can be performed at the same time. Also, during any of the conventional NO2-based regeneration, active NO2-based regeneration with enchanced effective NO2 supply, or active O2-based regeneration, the regeneration can be switched to NO2-based regeneration using recirculated NOx, or vice versa.

The controller 53 can also be arranged to adjust NOx levels in the exhaust gas stream for purposes of adjusting the rate of conventional and/or active NO2-based regeneration with enhanced effective NO2 supply and/or control of NOx production from the engine 23, ordinarily by adjusting local flame temperature in cylinders of an engine upstream of the DPF. This can be accomplished by, for example, appropriate adjustment of one or more of fuel injection timing and/or fuel injection pressure of a fuel injection system 61, vane position in a turbocharger 63, and EGR valve 65 position, as well as by other actuators, such as a throttle, all of which can be controlled by the controller 53. In this way, NOx available for conventional NO2-based regeneration or active NO2-based regeneration with enhanced effective NO2 supply or NO2-based regeneration using recirculated NOx, as well as NOx emissions from the EATS 21, can be adjusted. Typically, in active NO2-based regeneration with enhanced effective NO2 supply, NOx levels at the inlet of the DPF are controlled by increasing them to above levels that the gas would ordinarily have, which levels are typically those set by environmental legislation. The extent to which NOx levels are controlled will typically depend upon factors such as the particular source of NOx, e.g., diesel engines of different sizes, and other operating conditions, and may vary widely from system to system.

Mechanical means 67 (shown in phantom) for recirculating gas through the conduit 29 can be provided, such as by providing a pump in the conduit, or gas can be recirculated by a venturi effect resulting, for example, from gas flow through the exhaust line 69 upstream of the DPF.

In a method for regenerating the DPF 25 according to an aspect of the present invention, soot in a catalyzed DPF 25 is oxidized with NO2 so that CO, CO2, and NO are formed. According to the method, a NOx containing gas is introduced into the catalyzed DPF 25, and a temperature of at least one of the DPF, the captured soot, and the NOx containing gas is controlled, such as via a heating arrangement 47, and NOx levels at the inlet of the DPF are controlled so that the NOx containing gas reacts with the catalyst to form NO2 molecules that thereafter react with soot particles to form CO, CO2, and NO molecules and a NO2 efficiency is greater than 0.52 gC/gNO2 and so that less than two thirds of the soot mass that is removed from the DPF is oxidized by O2 molecules in the gas to form CO and CO2 molecules.

A temperature of at least one of the DPF 25, the captured soot, and the NOx containing gas will ordinarily be controlled such that the temperature is less than or equal to about 550° C., or less than or equal to about 500° C., and, ordinarily, above at least 450° C. NOx from downstream of the DPF 25 can be recirculated to upstream of the DPF, ordinarily upstream of any diesel oxidation catalyst (DOC) 43 upstream of the DPF that is provided. Temperature at an inlet of the DOC 43 can be controlled such as by injecting a hydrocarbon into a diesel engine exhaust stream upstream of the DOC.

Various measures can be taken to adjust the composition of the NOx-containing gas entering the DPF. Air/O2 can be injected upstream of the DPF. NOx production in a diesel engine upstream of the DPF can be adjusted, such as by adjusting local flame temperature in cylinders of an engine upstream of the DPF.

An NO2-based regeneration of the DPF 25 using recirculated NOx can be performed by recirculating at least some of the NO from the DPF and forming NO2 by reacting the recirculated NO with O2 at one or more reaction regions 37, 39, and/or 41. During NO2-based regeneration using recirculated NOx, at least some of the NO2 that oxidizes soot in the DPF 25 is NO2 formed from or carried by the recirculated gas. Temperature at an inlet 45 of the DPF 25 is ordinarily controlled during active NO2-based regeneration with enhanced effective NO2 supply and NO2-based regeneration using recirculated NOx when performed using a catalyzed DPF such that the temperature is about 500° C. and above at least 450° C.

During NO2-based regeneration using recirculated NOx, NOx from a point 31 downstream of the DPF 25 is recirculated to a point 33 upstream of the DPF. Air/O2 can be injected upstream of the DPF 25 during active regeneration, such as at a reaction region 37 at which the O2 will react with recirculated NO to form recycled NO2. In addition, or alternatively, the recirculated NO can be reacted with O2 in the presence of a catalyst during active regeneration, such as in a reaction reel on 41 in a DOC 43 and/or a reaction region 39 in a catalyzed DPF 25.

NOx gases that exit from the DPF 25 and that are not recirculated can be treated to reduce NOx levels, such as in an SCR 49 downstream of the DPF. Air/O2 can be injected at a point 51 downstream of the DPF and upstream of the SCR and some of the injected air/O2 can be recirculated with the recirculated NOx to facilitate formation of NO2 for use in the NO2-based regeneration using recirculated NOx. The injected air/O2 can also be used to control temperatures at an inlet of the SCR 49.

NOx production can be controlled, such as by the controller 53, in the diesel engine 23 upstream of the DPF 25, such as by controlling the local flame temperature in the cylinders of the engine. This can be accomplished by, for example, adjusting timing and pressure of fuel injection of a fuel injection system 61, vane position of a turbocharger 63, and position of an EGR valve 65. In this way, NOx available for conventional NO2-based regeneration or active NO2-based regeneration with enhanced effective NO2 supply or NO2-based regeneration using recirculated NOx, as well as NOx emissions from the EATS 21, can be adjusted.

Active O2-based regeneration can be initiated, such as by the controller 53, based on soot loading levels in the DPF or some characteristic indicative of, e.g., soot loading levels, such as a pressure drop across the DPF 25. Additionally, NO2-based regeneration using recirculated NOx can be terminated, such as by closing a valve 57 in the conduit 29, and active O2-based regeneration or conventional NO2-based regeneration or active NO2-based regeneration with enhanced effective NO2 supply including oxidation of soot without recirculated NO2 can be performed. In this way, regeneration rate of the DPF and/or NOx emissions from the EATS 21 can be adjusted.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A method for regenerating a catalyzed diesel particulate filter (DPF) via active NO2-based regeneration with enhanced effective NO2 supply, comprising:

introducing a NOx containing gas into the DPF; and by controlling a temperature of at least one of the DPF, the NOx containing gas, and soot in the DPF while also controlling NOx levels at an inlet of the DPF performing a first reaction where NO2 molecules present in the NOx containing gas or formed from NO molecules present in the NOx containing gas react with soot particles in the DPF to form CO, CO2, and NO molecules, and performing one or more second series of reactions where, before exiting the DPF, NO molecules resulting from a preceding one or more of the first reaction and a reaction of the second series of reactions and O2 in the DPF form more NO2 molecules that subsequently react with more soot in the DPF so that NO2 efficiency is greater than 0.52 gC/gNO2 and so that less than two thirds of the soot mass that is removed from the DPF is oxidized by O2 molecules in the gas to form CO and CO2 molecules.

2. The method as set forth in claim 1, comprising controlling temperature of the at least one of the DPF, the NOx containing gas, and soot in the DPF while controlling NOx levels at the inlet of the DPF so that less than one half of the soot mass that is removed from the DPF is oxidized by O2 molecules in the gas to form CO and CO2 molecules.

3. The method as set forth in claim 1, comprising controlling temperature of at least one of the DPF, soot in the DPF, and the NOx containing gas such that the temperature is less than or equal to about 550° C.

4. The method as set forth in claim 1, comprising controlling temperature of at least one of the DPF, soot in the DPF, and the NOx containing gas such that the temperature is less than or equal to about 500° C.

5. The method as set forth in claim 1, comprising controlling temperature of at least one of the DPF, soot in the DPF, and the NOx containing gas such that the temperature is above about 450° C.

6. The method as set forth in claim 1, comprising recirculating NO from downstream of the DPF to upstream of the DPF.

7. The method as set forth in claim 6, comprising recirculating NO to upstream of a diesel oxidation catalyst (DOC) upstream of the DPF.

8. The method as set forth in claim 7, comprising controlling temperature at an inlet of the DOC by injecting a hydrocarbon into a diesel engine exhaust stream upstream of the DOC.

9. The method as set forth in claim 1, comprising injecting O2 upstream of the DPF.

10. The method as set forth in claim 1, comprising controlling NOx levels at the inlet of the DPF by controlling NOx production in a diesel engine upstream of the DPF.

11. The method as set forth in claim 1, comprising controlling NOx levels at the inlet of the DPF by adjusting local flame temperature in cylinders of an engine upstream of the DPF to adjust NOx production.

12. The method as set forth in claim 1, comprising controlling temperature of at least one of the DPF and the NOx containing gas by injecting a hydrocarbon into a diesel engine exhaust stream upstream of the DPF.

13. The method as set forth in claim 12, comprising oxidizing the hydrocarbon in the presence of a catalyst.

14. The method as set. forth in claim 12, comprising oxidizing the hydrocarbon in a burner system.

15. The method as set. forth in claim 1, comprising controlling temperature of at least one of the DPF and the NOx containing gas by heating the DPF.

16. The method as set forth in claim 1, comprising heating the DPF with an electrical heater.

17. The method as set forth in claim 1, comptising heating the soot with microwaves.

18. The method as set forth in claim 1, wherein the NO2 efficiency is greater than or equal to 1.04 gC/gNO2.

19. The method as set forth in claim 1, comprising controlling mass flow of the NOx containing gas.

20. A diesel engine arrangement comprising:

a diesel engine arranged to introduce a NOx containing gas into a catalyzed diesel particulate filter (DPF);

a heating arrangement arranged to control a temperature of at least one of the DPF, the NOx containing gas, and soot in the DPF; and a controller arranged to perform an active NO2-based regeneration with enhanced effective NO2 supply by controlling the diesel engine and the heating arrangement to control temperature and to control NOx levels at an inlet of the DPF wherein, in the active NO2-based regeneration with enhanced effective NO2 supply, in a first reaction, NO2 molecules present in the NOx containing gas or formed from NO molecules present in the NOx containing gas react with soot particles in the DPF to form CO, CO2, and NO molecules, and, in one or more second series of reactions, before exiting the DPF, NO molecules resulting from a preceding one or more of the first reaction and a reaction of the second series of reactions and O2 in the DPF form more NO2 molecules that subsequently react with more soot in the DPF so that a NO2 efficiency is greater than 0.52 gC/gNO2 and so that less than two thirds of the soot mass that is removed from the DPF is oxidized by O2 molecules in the gas to form CO and CO2molecules.

21. The diesel engine arrangement as set forth in claim 20, wherein the heating arrangement comprises a hydrocarbon injector arranged to control the temperature of at least one of the DPF and the NOx containing gas by injecting a hydrocarbon into a diesel engine exhaust stream upstream of the DPF.

22. The diesel engine arrangement as set forth in claim 21, comprising, a catalyst for oxidizing the hydrocarbon.

23. The diesel engine arrangement as set forth in claim 21, comprising a burner for oxidizing the hydrocarbon.

24. The diesel engine arrangement as set forth in claim 20, comprising a heater for beating the DPF.

25. The diesel engine arrangement as set forth in claim 20, comprising an electrical heater for heating the DPF.

26. The diesel engine arrangement as set forth in claim 20, comprising a microwave heater for heating the soot.

27. A method of regenerating a diesel particulate filter (DPF), comprising:

performing a first regeneration to at least partially regenerate the DPF b performing an active NO2-based regeneration with enhanced effective NO2 supply, the active NO2-based regeneration with enhanced effective NO2 supply comprising introducing a NOx containing gas into the DPF, and by controlling a temperature of at least one of the DPF, the NOx containing gas, and soot in the DPF while also controlling NOx levels at an inlet of the DPF performing a first reaction where NO2 molecules present in the NOx containing gas or formed from NO molecules present in the NOx containing gas react with soot particles in the DPF to form CO, CO2, and NO molecules, and performing one or more second series of reactions where, before exiting the DPF, NO molecules resulting from a preceding one or more of the first reaction and a reaction of the second series of reactions and O2 in the DPF form more NO2 molecules that subsequently react with more soot in the DPF so that NO2 efficiency is greater than 0.52 gC/gNO2 and so that less than two thirds of the soot mass that is removed from the DPF is oxidized by O2 molecules in the gas to form CO and CO2 molecules; and performing a second regeneration to at least partially regenerate the DPF by performing at least one of a conventional NO2-based regeneration and an active O2-based regeneration.

28. The method as set forth in claim 27 wherein the first regeneration is performed before the second regeneration.

29. The method as set forth in claim 27 wherein the first regeneration is performed after the second regeneration.

30. The method as set forth in claim 27, wherein the first regeneration is performed after a regeneration to at least partially regenerate the DPP by performing the conventional NO2-based regeneration and before a regeneration to at least partially regenerate the DPF by performing the active O2-based regeneration.

31. The method as set forth in claim 27, comprising performing an NO2-based regeneration of the DPF using recirculated NOx.

32. The method as set forth in claim 31, wherein the NO2-based regeneration of the DPF using recirculated NOx is pertbrmed simultaneously with at least one of the conventional NO2-based regeneration, the active NO2-based regeneration with enhanced effective NO2 supply, and the active O2-based regeneration.

33. The method as set forth in claim 31, wherein the NO2-based regeneration of the DPF using recirculated NOx is performed before at least one of the conventional NO2-based regeneration, the active NO2-based regeneration with enhanced effective NO2 supply, and the active O2-based regeneration.

34. The method as set forth in claim 31, wherein the NO2-based regeneration of the DPF using recirculated NOx is performed after at least one of the conventional NO2-hased regeneration, the active NO2-based regeneration with enhanced effective NO2 supply, and the active O2-based regeneration.

35. The method as set forth in claim 27, wherein controlling NOx levels at the inlet of the DPF consists of controlling NOx production in a diesel engine upstream of the DPF.

36. The method as set forth in claim 1, wherein controlling NOx levels at the inlet of the DPF consists of controlling NOx production in a diesel engine upstream of the DPF.

* * * * *